US010849472B2

(12) United States Patent
Clegg, Sr.

(10) Patent No.: US 10,849,472 B2
(45) Date of Patent: Dec. 1, 2020

(54) COMBINATION BACKPACK VACUUM CLEANER AND CADDY

(71) Applicant: Dale Clegg, Sr., Hartford, CT (US)

(72) Inventor: Dale Clegg, Sr., Hartford, CT (US)

( * ) Notice: Subject to any disclaimer, the term of this patent is extended or adjusted under 35 U.S.C. 154(b) by 336 days.

(21) Appl. No.: 15/991,603

(22) Filed: May 29, 2018

(65) Prior Publication Data

US 2019/0365169 A1 Dec. 5, 2019

(51) Int. Cl.
*A47L 9/00* (2006.01)
*A47L 5/36* (2006.01)

(52) U.S. Cl.
CPC ..... *A47L 9/009* (2013.01); *A47L 9/0063* (2013.01); *A47L 5/365* (2013.01); *A47L 9/0054* (2013.01)

(58) Field of Classification Search
CPC ..... A47L 9/009; A47L 9/0063; A47L 5/365; A47L 9/0018; A47L 7/0019; A47L 9/0054
See application file for complete search history.

(56) References Cited

U.S. PATENT DOCUMENTS 6,553,610 B1 4/2003 Shideler
8,181,833 B2 5/2012 Wangeby et al.
9,456,722 B2 10/2016 Tomasiak et al.
9,486,120 B2 11/2016 Day

*Primary Examiner* — David Redding
(74) *Attorney, Agent, or Firm* — Lathrop GPM LLP; Wm. Tucker Griffith

(57) ABSTRACT

A caddy is provided for mounting a vacuum cleaner for transport and use. The caddy comprises a lower support assembly mounted on a plurality of wheels, a vertical support assembly comprising at least two members vertically extending from the lower support assembly, and an intermediate support mounted on the vertical mounting assembly a vertical distance up from the lower support assembly. The lower support assembly includes centrally-located mounting guides for receiving and holding the vacuum cleaner. The intermediate support comprises a generally circular-shaped member having an opening for facilitating the insertion and removal of the vacuum cleaner from the caddy. A lead is attached to the lower support assembly and may be connected to an intermediate location on a hose of the vacuum cleaner for redistributing a pulling force applied to the hose between the top of the vacuum cleaner and the lower support assembly of the caddy during use.

20 Claims, 7 Drawing Sheets

COMBINATION BACKPACK VACUUM CLEANER AND CADDY

FIELD OF INVENTION

The present invention generally relates to portable vacuum cleaners, and more particularly relates to a caddy for a vacuum cleaner, as well as, a combination vacuum cleaner and caddy, that improve the use, portability and versatility of such a vacuum cleaner.

BACKGROUND OF THE INVENTION

Many vacuum systems and designs are known in the art. Specific applications for vacuum cleaners include, but are not limited to, general home cleaning, cleaning commercial properties, and cleaning schools and theaters. Commercial cleaning services can be and are often big businesses, with large cleaning services having multiple employees cleaning many different properties at all hours of the day. For such cleaning services, it is advantageous to be able to clean a property quickly without compromising the cleaning process. As a result, such services are hampered when equipment malfunctions, employees are sick or hurt, or it simply takes too long to clean a room or building. Vacuum cleaners are frequently used at a property to clean floors, carpets, stairs, window sills and curtains, furniture, and the like. So a portable and versatile vacuum cleaner is highly desirable to commercial cleaning services.

Vacuum cleaner portability is advantageous, even to a homeowner, because such portability makes use of the vacuum easier, especially in rooms having larger size or unique shapes and configurations. Portability also enables a vacuum to be used at different physical locations, within the same building or even in different buildings. Commercial cleaning services—which usually clean large spaces and buildings such as office buildings, schools, hotels, theaters, and the like—focus on jobs and locations that require frequent cleaning (often nightly), and usually require workers to cover multiple rooms, floors and locations in the same day. As a result, quick and efficient cleaning is required without comprising the actual cleaning of a room or space. Accordingly, portable vacuums are desirable so that every inch of a space, room and building can be cleaned as quickly as possible, including stairs, ramps and under seats and furniture.

Versatility of vacuum cleaners is also desirable. A versatile vacuum cleaner will allow a cleaner to use a single vacuum in various manners specific to different applications, for example in wide open spaces, under furniture, up stairs and ramps, and in tight spaces. It is likewise desirable to have a single vacuum that can clean both carpeted surfaces and hardwood surfaces, and the like, while also being capable of use on window sills, curtains, and furniture, as desired. It is therefore desirable to only need a single vacuum to cover all such spaces, because needing to have many different vacuums to cover different spaces and surfaces would be more costly to a cleaning service and moreover would be more time intensive, requiring the worker to make more passes over a space to ensure that everything is properly cleaned.

Types of portable vacuum cleaners in the prior art include traditional upright vacuums, wheel-rolled canister vacuums, shop-vacuums, and harness or backpack mounted vacuums. An example of a prior art harness or backpack vacuum is illustrated in FIG. 1. An example of a prior art wheel-rolled canister vacuum is illustrated in FIG. 2.

Harness or backpack vacuums of different types have been developed to assist in carrying the vacuum by a user in a manner intended to free up the user's hands during transport and use of the vacuum. Such harness vacuums are commonly used by commercial cleaning services because a worker can easily move around a room and a building while wearing the vacuum, and thus conceivably complete cleaning more quickly. Referring to FIG. 1, such a harness vacuum 10 typically comprises a canister 12 having a bottom mounted motor 14 and a top mounted flexible hose 16 in communication with an interior receptacle within the canister 12 for collecting dirt, dust and other debris sucked up by the vacuum 10. In operation, a vacuum force created by the motor 14 pulls such dirt, dust and debris into the collection receptacle, which can include a collection bag, through the hose 16. A harness 18 is mounted on the outside of the canister 12 and often comprises a waist belt 20 and shoulder straps 22, which may be mounted directly to the canister 12 or alternatively to a backing plate 24 removably mounted to the canister 12. With such a design, the user can slip the vacuum 10 on and off. When mounted on the user's back, the waist belt 20 can be clasped, such as by a buckle, and the shoulder straps 22 slipped over the user's shoulder like a backpack, so that the user's hands are free to grasp the hose 16 and operate the vacuum 10. When worn, the vacuum 10 generally sits on the user's back much like a backpack. The hose 16 and attachments 26 extend out and around the front by the user's side. Again, these types of vacuums are popular, especially for commercial cleaning services, because they are easily carried within a room, from room to room, up and down stairs and ramps, from floor to floor, and in and out of buildings.

Wheel-rolled vacuums of different types have likewise been developed to make a vacuum canister portable by moving it around a floor on wheels or casters. Such vacuums are more versatile than traditional upright vacuums, however, less easily moved within a space and between rooms than a harness vacuum. Referring to FIG. 2, a wheel-rolled vacuum 50 generally includes a canister 52 provided on a plurality of wheels or casters 54 that typically can swivel allowing the vacuum 50 to move freely both back and forth as well as side to side. The canister 52 typically includes a flexible hose 56 projecting tangentially out of the side of the canister 52. A motor 58 is mounted on within the top cover 60 of the vacuum 50 to generate a vacuum force within the canister 52 and pull in dirt, dust and debris through the hose 56. The top cover 60 can be removed to empty the canister 52 when full.

Such prior art vacuum cleaners purport to provide more mobility and portability for the user. However, various drawbacks of prior art vacuum cleaners have been identified in use, especially by cleaning services that make frequent—indeed daily—use of such vacuums. For example, the use of the more popular harness vacuum has proven to be taxing on the user, especially for use in commercial cleaning of many rooms, floors, and buildings in succession. When worn, such harness vacuums add a lot of weight and pressure on the user's back, shoulders and neck, especially when worn for a long time and as the canister fills up with debris. Moreover, the user is usually wearing the vacuum—like a backpack—as she walks from room to room, and up and down stairs or ramps. The user can take off the vacuum to rest or perform other tasks, but it is equally taxing on the user's body to take off the canister and to lift it up to put it on again because the user typically needs to bend over to set it down and pick it up. Additionally, when the canister is not worn using the harness, it is susceptible to tipping over. In this regard, it is also difficult to empty the canister, which often uses a top-loaded bag. To empty the canister, the top of the unit is taken off to remove the bag, but again, such harness vacuums are not easy to balance on the floor. First, the harness itself—located on one side of the canister—throws off the balance of the unit. Second, pulling the bag from the canister usually jostles the vacuum and makes it off balance as well. So, when emptying the canister, the entire vacuum can tip over and spill all the dirt and debris that had been cleaned up. Accordingly, there is a desire for a means to easily balance the canister vacuum without compromising its use, portability and versatility, both to ease the wear on the user and to facilitate the emptying of the canister.

A harness vacuum, even though it is worn on the back to make it easier to transport, is actually difficult to transport with other objects that may be needed to fully clean a commercial property. For example a user, to do a complete cleaning job, may often need cleansers and sprays, rags, dusters, brooms, mops, and the like. However, when transporting a harness vacuum, the user needs to carry the hose and any attachments therefor, as well as a very long power cord. Therefore, the user's hands likely are not free to carry other objects or even push a cleaning cart at the same time. Thus, in order to do a complete cleaning job, the user will need to first vacuum a space, return the vacuum to a cleaning closet—which may be on the other side of the building or even on a different floor—and then go back to the room with a cleaning cart and other cleaning equipment to finish the job. This approach is inefficient and time-consuming, and not desirable to a commercial cleaning service's bottom line.

When using a harness vacuum, with the canister mounted on the user's back, it is also difficult for the user to bend over, for example to pick-up something on the floor interfering with the vacuum hose and nozzle, or to plug in or unplug the power cord, or even to pick up the end of the power cord to move it to a new room. During a single shift on a cleaning service crew, a user may need to bend over dozens of times. With the canister on one's back, which is already very taxing and heavy for most users, the weight of the canister can shift and further hurt the user's back. In this regard, harness vacuums—though intended to make the cleaning process easier by adding more portability—have actually increased inefficiency due to worker downtime and worker's compensation claims because of the greater wear on the users. Accordingly, there is a need for a portable vacuum cleaner that is less taxing on the user without affecting the portability and versatility of the vacuum, in use and/or in transit.

When a harness vacuum is worn on the user's back and used for long stretches of time, the user's back is also exposed to heat from the vacuum's motor. This makes the user uncomfortable and requires frequent breaks so that the motor can cool down. Workers are also susceptible to burning and injury. Again, there is a need for a portable vacuum cleaner that is more safe for the user without affecting the portability and versatility of the vacuum in use.

As noted above, alternate vacuum options include canister vacuums or shop-vacuums having low profiles, and which are pulled around on wheels or casters. Such commercial versions of these types of vacuums have drawbacks when used in commercial cleaning applications. Firstly, such wheel-rolled vacuums are easily tipped over—often due to their design, where the hose extends out from the side of the canister, as illustrated in FIG. 2. In operation, the vacuum is usually moved around using the hose. That is, the user usually has both hands on the hose to vacuum and pulls the vacuum around like a pet on a leash. Secondly, such vacuums are usually too short and have no accessible handle to assist the user to move the canister. Often, when not in use, a canister vacuum will need to be carried, with both hands, to get it to a room for use. This clearly ties up a user's hands to the extent that they cannot even carry the hose or any needed attachments, which result in multiple time-consuming trips just to vacuum a single room. Moreover, such vacuums are often bulky, oddly-shaped, and heavy, and therefore difficult to transport from room to room, floor to floor.

In commercial uses of wheel-rolled vacuums, users try to cover a large space in a short amount of time. As noted, such vacuums are usually pulled around via the hose, especially during use of the vacuum. These types of vacuums are not generally useful in large spaces because if they are pulled too quickly—exclusively by the hose—their center of mass is insufficient to compensate for a high pulling force applied to the vacuum by the user pulling on the hose. This is especially true if the wheels are twisted or turned so that the vacuum itself in unbalanced on the floor. Additionally, such vacuums are also easily tipped over if the wheels contact an object on the floor—most notably, the power cord, which frequently gets in the way. Far too often, a wheel will contact the power cord and stop rolling while a pulling force is being applied on the vacuum via the hose attached midway up the side of the canister. When the pulling force is not enough to dislodge the wheel but too strong at the spot where the hose is attached to the canister, then the vacuum can tip over or the hose can be dislodged from the canister. Accordingly, there is a need for a means to easily pull a wheeled vacuum without the risk of the vacuum tipping over regardless of how much pulling force is applied, including if applied by the hose. Additionally, there is a need for a portable vacuum that can be easily pulled around and overcome any obstacles on the floor, like the power cord, during use.

In view of the foregoing, there is a need for a vacuum cleaner that is easy to transport and use without being too taxing on the user, and which can therefore in commercial cleaning situations reduce worker injuries and downtime. Further, there is a need for a vacuum cleaner that is easy to clean without risking it tipping over, easy to store, even temporarily, without tipping over, and easy to transport while freeing the user's hands for performing other tasks, carrying other objects, or at least permitting transport of multiple cleaning products at the same time. In this regard, there is a need for a vacuum cleaner with means for storing the hose, attachments, power cord, and the like, preferably with the vacuum itself, so that the user's hands are freed up to carrying other objects as necessary. There is also a need for a portable vacuum cleaner that can be used both as a harness vacuum and a wheel-rolled canister vacuum, as desired. When such a vacuum cleaner is used as a wheel-rolled vacuum, and pulled by the hose as is common, there is a need for a design that is not easily tipped over, thereby minimizing stoppages or the need for the user to bend over to pick-up obstructions or move the power cord. When such a vacuum cleaner is used as a portable harness vacuum, there is a need for a vacuum cleaner design permitting such use, but also providing a means for holding, storing, moving and even using such a vacuum when it is not being worn.

Accordingly, it is a general object of the present invention to provide a portable vacuum cleaner that improves upon conventional vacuum cleaners currently on the market and that overcomes the problems and drawbacks associated with such prior art vacuum cleaners.

SUMMARY OF THE INVENTION

In accordance with the present invention, a vacuum cleaner caddy is provided for mounting a vacuum cleaner canister for transport and/or use. In general, the caddy comprises a lower support assembly having a plurality of wheels mounted to a bottom surface thereof, a vertical support assembly comprising at least two members vertically extending from the lower support assembly, and an intermediate support mounted on the vertical mounting assembly a vertical distance up from the lower support assembly. The lower support assembly includes centrally located mounting guides for receiving and holding a canister vacuum cleaner. The intermediate support comprises a generally circular-shaped member having an opening for facilitating the insertion and removal of the vacuum cleaner from the caddy. A lead is attached to the lower support assembly and may be connected to an intermediate location on a hose of the canister vacuum cleaner for redistributing a pulling force applied to the hose between the top of the vacuum cleaner and the lower support assembly of the caddy.

In an aspect of the present invention, the caddy provides means for holding and/or storing the vacuum cleaner hose, nozzles, attachments and power cord, when not in use.

In accordance with embodiments of the present invention, the caddy includes storage units for other cleaning products and accessories, such as additional vacuum cleaner attachments, cleansers, sprays, rags and sponges, dusters, and the like. Such storage units can be removable from the caddy. In one aspect of the present invention, a first storage unit can be removably mounted to the intermediate support. In another aspect of the present invention, a second storage unit can be removably mounted to the vertical support assembly.

In accordance with embodiments of the present invention, the vacuum cleaner caddy can be used with existing canister vacuums, and in particular, prior art harness or backpack vacuum cleaners. The harness vacuum cleaner can be mounted in and secured to the caddy for transport and use, but also removable from the caddy for use as a harness vacuum cleaner. In an aspect of the present invention, the design of the caddy does not inhibit the user's ability to quickly and easily pick-up and put on the harness vacuum, or to quickly and easily take off the harness vacuum and mount it back into the caddy in the proper position and orientation.

In accordance with another embodiment of the present invention, a combination caddy and canister vacuum is provided that provides a portable and versatile vacuum cleaner that can be used as both a wheel-rolled canister vacuum and a harness vacuum, as desired.

These and other objects, features and advantages of the present invention will become apparent in light of the detailed description of embodiments thereof, as illustrated in the accompanying drawings.

DETAILED DESCRIPTION OF THE DRAWINGS

Figure 1:
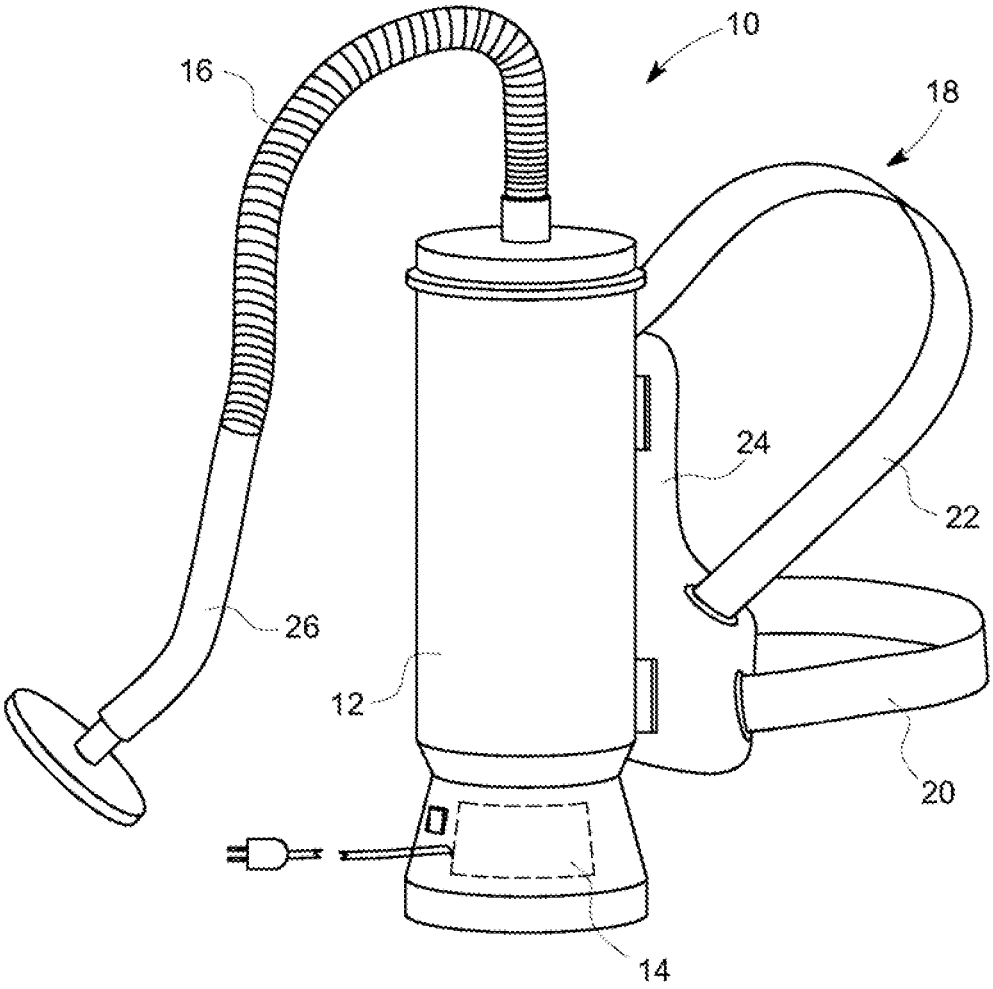
FIG. 1 shows a prior art harness or backpack style vacuum cleaner.
Figure 2:
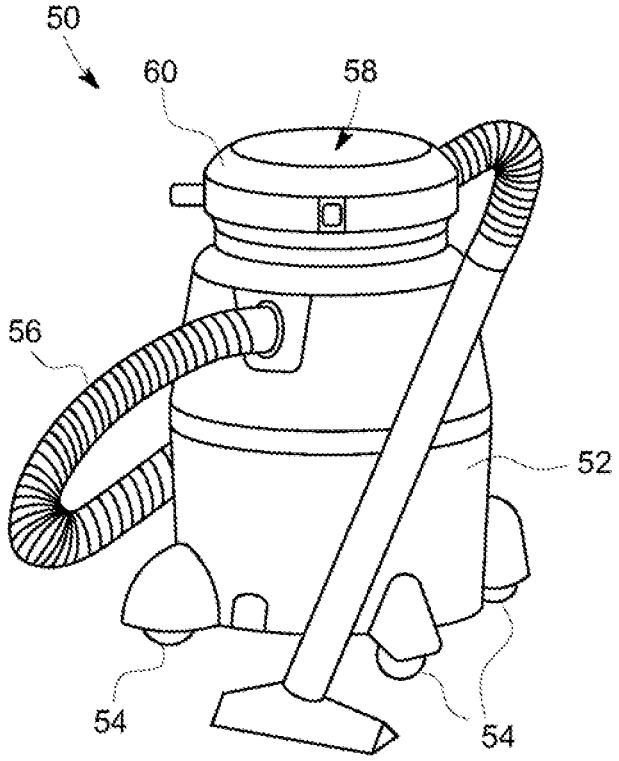
FIG. 2 shows a prior art wheel-rolled canister vacuum cleaner.
Figure 3:
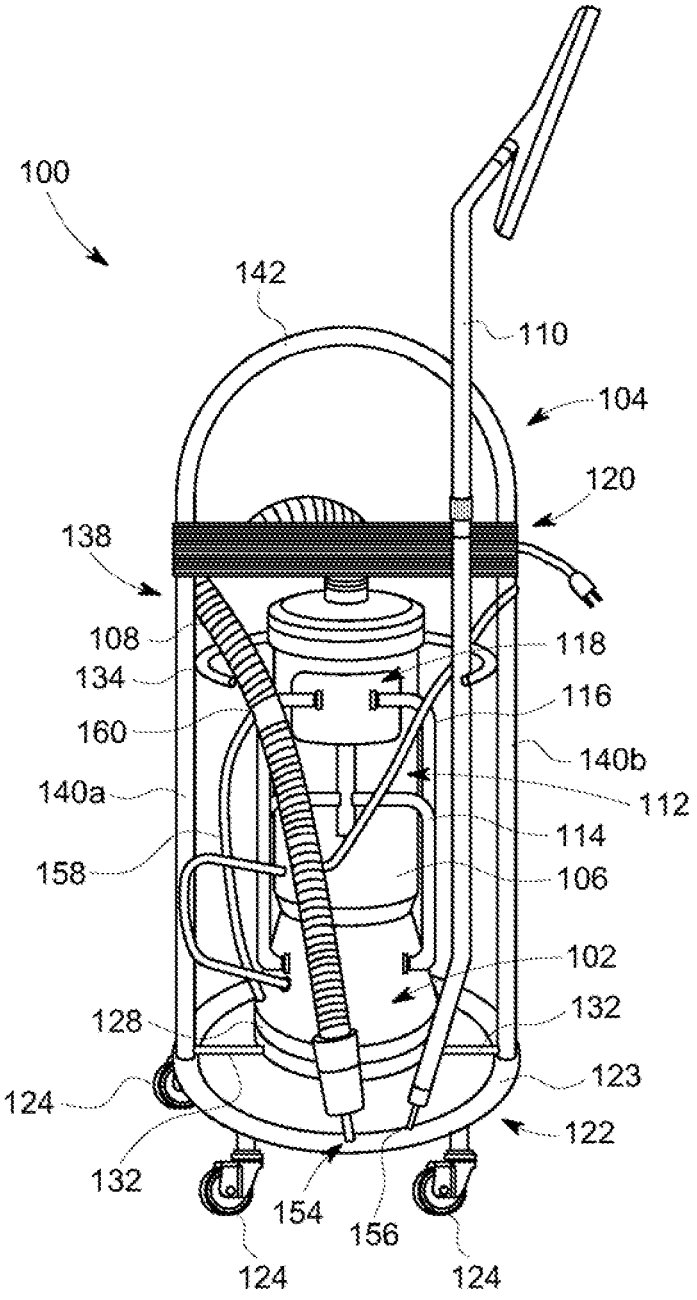
FIG. 3 illustrates a perspective view of a combined vacuum cleaner and caddy in accordance with an embodiment of the present invention.

A combination vacuum cleaner and caddy in accordance with an embodiment of the present invention is illustrated in FIG. 3, and generally designated as reference numeral 100. As illustrated, a vacuum cleaner 102 is a canister-style vacuum cleaner that more preferably can be used as a harness or backpack vacuum cleaner apart from the caddy 104. In accordance with the present invention, the caddy 104 is designed for easy and efficient transport and use of the canister vacuum 102 that improves on the portability and versatility of prior art vacuum cleaners, such as those designs generally illustrated in FIGS. 1-2.

Referring to FIG. 3, a canister vacuum 102 comprises a vertical canister 106 with a top-mounted hose 108 extending upwardly and outwardly therefrom. In use, a collection bag, as is generally known in the art, may be provided inside the canister 106 for collecting dirt, dust, debris, and the like, drawn via the hose 108 in by a vacuum force generated by a motor (not shown) mounted within the vacuum 102. Various nozzles and attachments, such as the rigid hose extension and nozzle illustrated in FIG. 3 and generally designated as reference numeral 110, may be mounted on the end of the hose 108 as necessary for performing a variety of cleaning tasks or using the vacuum 102 on a variety of surfaces. Such attachments 110 are typically provided with the vacuum 102 and optimally kept with the vacuum 102 for use as needed. With the caddy 104, in accordance with the present invention, the attachments 110 are easily stored on the caddy 104, freeing up the user's hands for carrying other objects or performing other tasks.

Referring again to FIG. 3, the canister 106 includes a harness 112 so that it can be worn backpack-style for use of the vacuum 102, as is known in the art. Such harness or backpack vacuums are useful for cleaning in tight spaces, on stairs and ramps, and for cleaning under certain types of furniture, including rows of seats in a theater. As illustrated, the harness 112 includes a horizontally extending waist belt 114 and two vertically extending shoulder straps 116 each mounted to and extending from a backing plate 118 mounted on the canister 106.

In accordance with preferred embodiments of the present invention, a caddy for mounting, transporting, storing and using the vacuum cleaner 102 is illustrated in more detail in FIGS. 4-7 and generally designated as reference numeral 104. In accordance with the present invention, the caddy 104 permits the canister vacuum 102 to be used in an efficient and portable manner without needing to be worn on the user's back. Indeed, the caddy 104 is specifically designed for use with preexisting commercial models of harness or backpack vacuum cleaners, and provides the user with the option of using the vacuum cleaner 102 as mounted on the caddy 104 or by wearing the vacuum cleaner 102 on one's back using the waist belt 114 and shoulder straps 116 and apart from the caddy 104, as desired. Such variability increases the portability and versatility of the vacuum cleaner 102 because, as noted in further detail below, a user of the combined vacuum cleaner and caddy 100 can transport and use the vacuum 102 without needing to always hold the hose 108, all attachments 110 and the power cord 120 together, and also transport other cleaning products with the caddy 104, and can take breaks at any time without needing to take off the vacuum cleaner 102 or worrying about the vacuum cleaner 102 tipping over.

Figure 4:
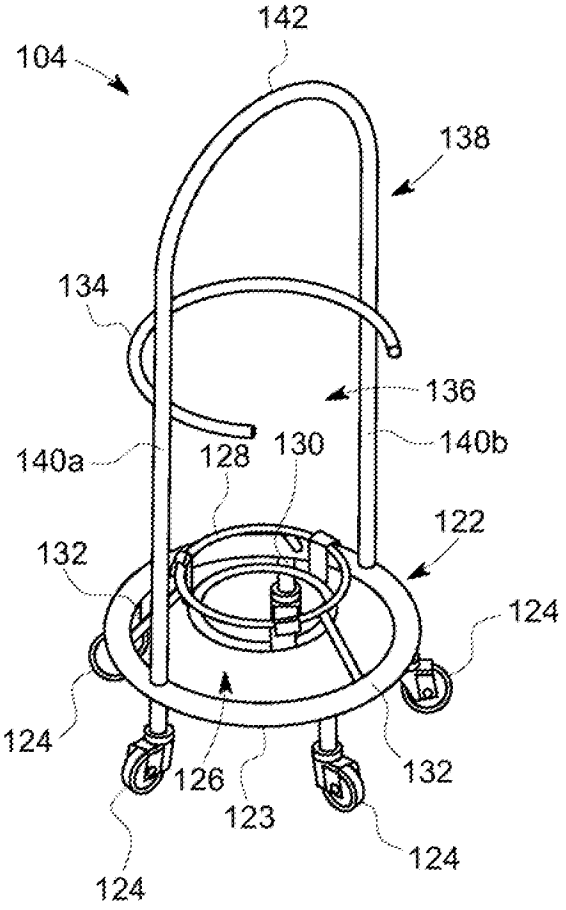
FIG. 4 shows a perspective view of a first embodiment of a caddy in accordance with the present invention.

Referring to FIG. 4, the caddy 104 includes a lower support assembly 122 upon which the canister 106 of the vacuum 102 can be mounted and preferably centrally located. A plurality of wheels or casters 124 is mounted to the bottom surface of the lower support assembly 122 for engagement with the floor. In preferred embodiments, the wheels 124 can swivel for optimal movement across the floor surface and regardless of the type of surface (e.g., hardwood, concrete or carpeted), and further be locked as desired. As shown in FIG. 4, the caddy 104 includes five wheels 124 equally distributed about the perimeter of the lower support assembly 122 and generally evenly arranged relative to a central axis of the caddy 104 which generally correlates to the central axis of the canister 106 when properly mounted on the caddy 104, and, as a result, the general center of mass of the combined vacuum and caddy 100.

As illustrated, the lower support assembly includes an outer support member 123 having a generally circular shape, though other shapes may be used without departing from the spirit and principles of the present invention. A circular shape is preferred to match the shape of the canister 106 of the vacuum 102 mounted therein. The general overall circular shape of the caddy 104, as depicted in the illustrated embodiments, also minimizes edges that can get caught on furniture or walls.

Figure 9:
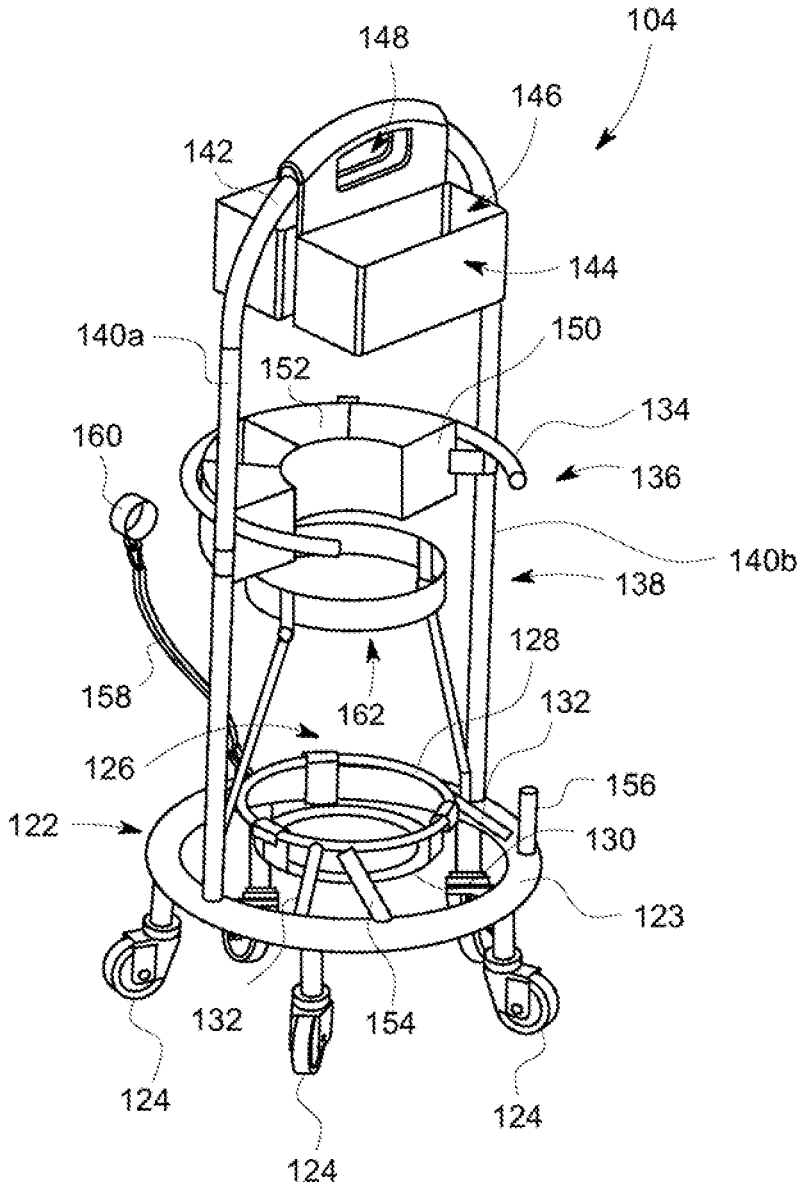
FIG. 9 shows a perspective view of a third embodiment of a caddy in accordance with the present invention.

The canister 106 is received by mounting guides 126 centrally located within to the lower support assembly 122 and generally complementing the shape and size of the canister 106 so that there is minimal shifting of the canister 106 during operation of the vacuum 102 as mounted to the caddy 104. Referring more particularly to FIG. 4, the central mounting guides 126 in accordance with preferred embodiments of the present invention, form a basket adapted to receive the lower end of the canister 106, and more preferably, snugly receive the lower end of the canister 106 to secure the vacuum 102 to the caddy 104. As illustrated, the basket 126 comprises an upper ring 128 and a lower ring 130. The upper ring 128 has a circular shape and diameter generally complementing the outer diameter of the canister 106. The lower ring 130 has a smaller diameter and is adapted to support the bottom surface of the canister 106. The canister 106 can further be secured and stabilized on the caddy 104 using fasteners, such as braces or straps 162, that can be connected to the canister 106, or wrapped around the canister 106 and clasped together, for example, using a buckle, as illustrated in FIG. 9. These additional fasteners are useful in situations where the vacuum canister 106 does not snugly fit within the basket 126, owing to the fact that the caddy 104 of the present invention can ideally be used with portable vacuum cleaners of varying designs, sizes and shapes. As further illustrated, the basket 126 is itself secured to the outer support member 123 of the lower support assembly 122 by support braces 132.

As an alternate to the basket 126, the caddy can use an upper ring 128, to receive the lower end of the vacuum canister 106, mounted atop support braces 132 that extend across the lower support member 123 in crisscross fashion to form a lower support adapted to support the bottom surface of the canister 106.

Such stabilization of the caddy 104 is assisted by an intermediate support 134 vertically located a distance up from the lower support assembly 122 that essentially braces a middle- to upper-portion of the canister 106. The intermediate support 134 has a generally circular shape so as to complement the shape and size of the canister 106. However, as illustrated in FIG. 4, the intermediate support 134 is not a completely closed shape and instead includes an opening space 136 so as to facilitate insertion and removal of the canister 106 relative to the caddy 104. In this regard, a user, if desiring to use the vacuum 102 as a harness or backpack vacuum cleaner, can easily remove the vacuum canister 106 from the caddy 104 and mount it on her back using the waist belt 114 and the shoulder straps 116 and in accordance with known operation of backpack vacuum cleaners. When the canister 106 is mounted on the caddy 104, the backing plate 118 and harness components 114, 116 are generally aligned with the opening space 136 of the intermediate support 134, as illustrated in FIG. 3.

While the intermediate support 134 generally complements the size and shape of the vacuum canister 106, it does not need to contact or fit snugly around the canister 106. Indeed, as illustrated in FIG. 3, there is some space between the canister 106 and the intermediate support 134, which can permit some slight side-to-side movement of the canister 106 during use to assist the movement of the combination vacuum and caddy 100 when being pulled around via the hose 108, as discussed below in connection with a lead 158 to prevent tipping of the unit 100). In alternate embodiments, the intermediate support could contact and directly brace the canister 106, if desired, without departing from the spirits and principles of the present invention.

Figure 6:
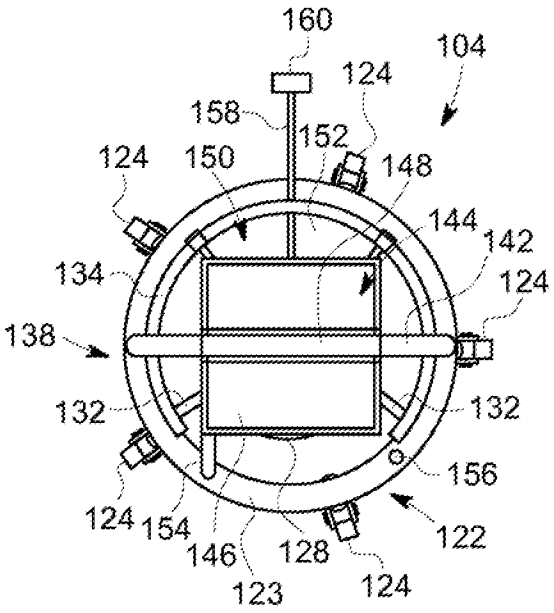
FIG. 6 shows a front perspective view of the caddy of FIG. 5.
Figure 7:
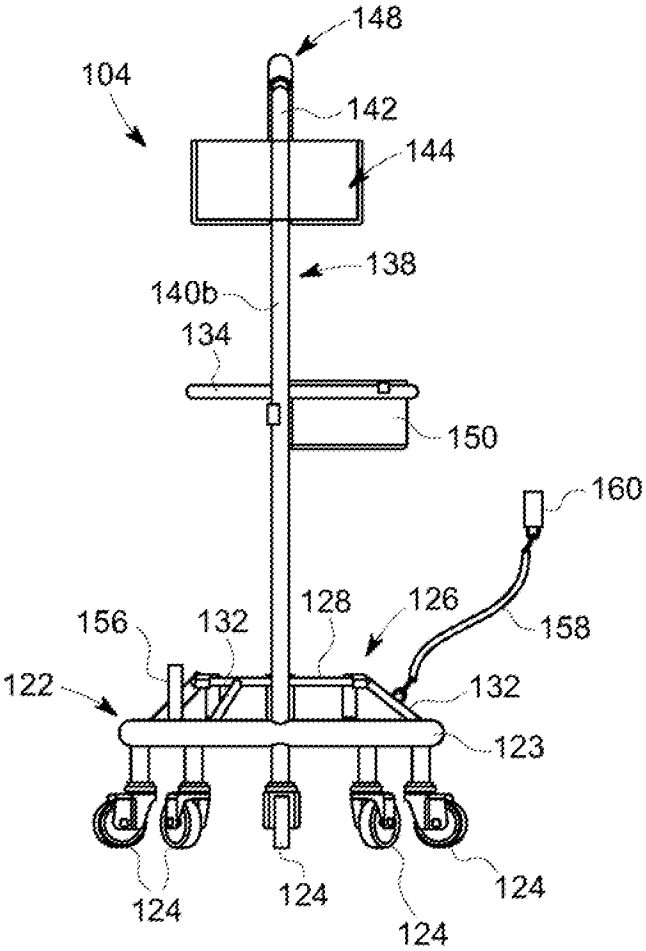
FIG. 7 shows a top perspective view of the caddy of FIG. 5.

The intermediate support 134 is attached to the caddy 104 and maintained a vertical distance up from the lower support assembly 122, as illustrated in FIG. 6, by a vertical support assembly 138 that generally protects the mounted vacuum 102 and stabilizes the caddy 104 during use and movement, while also providing a support structure for hose attachments and nozzles 110, additional cleaning products, and the power cord 120. In general, the vertical support assembly 138 comprises at least two generally vertical support members 140*a*, 140*b* extending upwardly from the outer support member 123 and horizontally spaced apart from one another. In preferred embodiments, the vertical support members 140*a*, 140*b* are connected at their upper ends by a horizontal member 142, more preferably an arced member as illustrated, that can act as a handle for moving the caddy 104 around.

Figure 5:
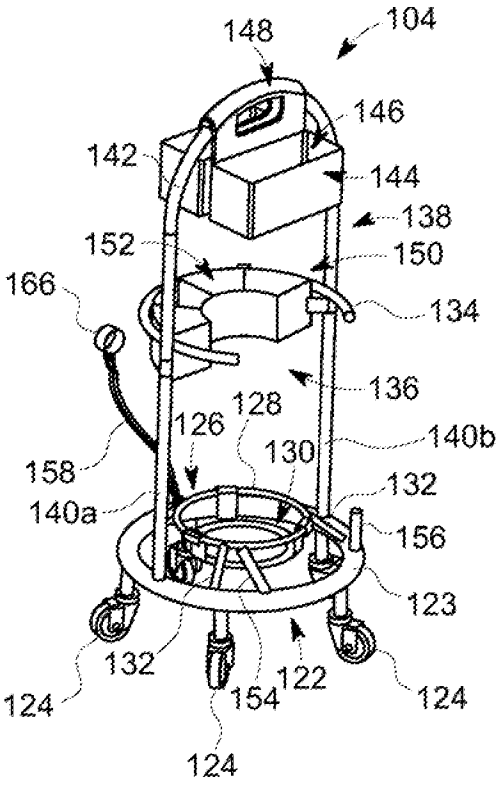
FIG. 5 shows a perspective view of a second embodiment of a caddy in accordance with the present invention.

Referring to FIG. 5, the horizontal member 142 of the vertical support assembly 138 can also be used to support a secondary storage unit 144, including individual storage containers 146, as illustrated, for example, to hold attachments for the vacuum, or cleaning accessories, such as rags, sponges, cleanser, spray bottles or the like. The support storage unit 144 can form a hand-held sub-caddy that can be removed from the caddy 104 and carried separately. As illustrated in FIG. 5, the sub-caddy 144 includes a separate handle slot 148 to facilitate carrying apart from the caddy 104. When the sub-caddy 144 is mounted on the caddy 104, as shown, the handle slot 148 can be used to move the entire caddy 104 around.

Additional storage units 150 are illustrated in FIG. 5 and attached to the intermediate support 134. These units 150 can include multiple storage containers 152 for cleaning products and the like, or alternatively, can include pass-through holes for receiving and holding longer objects, such as nozzles and attachments for the vacuum cleaner hose 108, dusters, brooms, mops, spray bottles, and the like. In embodiments of the present invention, the intermediate-level storage units 150 can be removed from the caddy 104 as desired. Additionally, such units 150 can be modular and various combinations of shapes and sizes, enclosed or opened, can be used so that the user can customize the arrangement that may be needed for best personalized use of the caddy 104. Such units 150 can also be mounted on the interior circumference of the intermediate support 134, and as so mounted, can be used to brace, support and hold the canister in place. Alternatively, the storage units 150 can be mounted on the outer circumference of the intermediate support 134.

In accordance with known designs of a canister vacuum 102, a power cord 120 in operative communication with the motor (not shown) extends out from the canister 106 for connection with a standard power outlet. In commercial cleaning uses of the vacuum 102, the power cord 120 is usually very long—for example, about 50 feet long. For home uses, the power cord 120 is usually smaller due to the smaller size of the area being cleaned. Regardless of the use or length of the power cord 120, standard canister vacuums 102 typically do not have a means for collecting and storing the power cord 120 when not in use. Often, users will simply wrap the cord 120 around the canister 106 when not in use; however, this is not helpful when the vacuum 102 is being worn on the user's back, so when transporting the vacuum 102 from room to room, the user typically needs to carry the cord 120 in one hand and the hose 108 and any attachments 110 in the other hand. In accordance with the present invention, means are provided on the caddy 104 for storing the power cord 120 when not in use or during transit of the caddy 104 from room to room. Referring to FIG. 3, the vertical support assembly 138 provides a means for storing the power cord 120 when not in use.

As noted, the vertical members 140*a*, 140*b* of the vertical support assembly 138 are horizontally spaced apart. When the vacuum 102 is not in use, the power cord 120 can be wrapped for storage and/or transport between the vertical members 140*a*, 140*b*. For example, as shown in FIG. 3, the power cord 120 can be wrapped around the two vertical members 140*a*, 140*b*. In alternate embodiments, projections or pawls can be added to a side of each of the vertical members 140*a*, 140*b* and provide means on which the power cord 120 can be wrapped for storage and/or transport. When the power cord 120 is wrapped on the caddy 104 in such a manner as shown in FIG. 3, it can easily be slid off the caddy 104 when it is needed for use. In this manner, the cord 120 is neatly organized in a circularly wrapped manner so as to eliminate the risk of any kinks or knots in the cord 120 as it is stretched out. When the user is done with the vacuum 102, it is a simple act of wrapping the cord 120 around and around the vertical support assembly 138, either around the vertical members 140*a*, 140*b*, as shown, or around provided projections, to store the power cord 120 in a simple but efficient manner.

The lower support assembly 122 also provides two projections 154, 156 generally upwardly extending therefrom. These projections are used to store the hose 108 and attachments 110 therefor when the vacuum 102 is not in use, such as generally illustrated in FIG. 3. In accordance with preferred embodiments of the present invention, the open end of the hose 108 can be slid over a first projection 154 when the hose 108 is not in use—for example, when the caddy 104 is being moved from room to room. The hose 108 remains on the caddy 104 as it is rolled around, which frees up the user's hands so that other objects—for example, a trash can or cleaning cart—can be transported along with the combination caddy and vacuum cleaner 100. In accordance with embodiments of the present invention, additional clips, projections, or straps can be used to secure the middle portion of the hose 108 in place on the caddy 104 in combination with the lower end first projection 154. As illustrated in FIG. 3, the intermediate support 134 can also be used to brace middle of the hose 108.

As suggested, a second projection 156 can be used to mount an attachment 110 for the hose 108, such as a nozzle or a rigid hose extension, as illustrated. In a similar manner as with storage of the hose 108, an open end of the attachment 110 can be slid over the second projection 156 to hold the attachment 110 in place. In accordance with embodiments of the present invention, additional clips, projections, or straps can be used to secure the attachment 110 in place in combination with the lower end second projection 156. As illustrated in FIG. 3, the intermediate support 134 can also be used to brace the hose attachment 110, here comprising a rigid hose extension with a nozzle attachment on the end thereof. Additional projections can be included, preferably disposed around the lower support member 123, for holding a variety of components relevant for cleaning services and use of the combination vacuum and caddy 100 described and shown herein.

Referring to FIGS. 5-8, the caddy 104 includes a lead 158 attached between the hose 108 and the lower support assembly 122 of the caddy 104. For example, the lead 158 could be attached to the lower support member 123 or one of the support braces 132. The lead 158 is provided to stabilize the combined vacuum cleaner and caddy 100 when it is being used to vacuum a space. More particularly, the lead 158 is attached to the hose 108 at an intermediate location thereof between the nozzle end and the end of the hose connected at the top of the canister 106. In the illustrated embodiment shown in FIG. 5, the lead 158 is attached to the hose 108 using a collar 160. It is preferred that the collar 160 can be easily removed from the hose 108 as desired, for example, by using a hook-and-loop fastening means on the collar 160. Additionally, it is preferred that the lead 158 be constructed from a flexible and more preferably elastic material, such as a bungee cord. This added flex helps distribute the pulling force applied to the hose 108 by the user, which in turn helps prevent the caddy 104 from tipping over as the user pulls on the hose 108.

Figure 8:
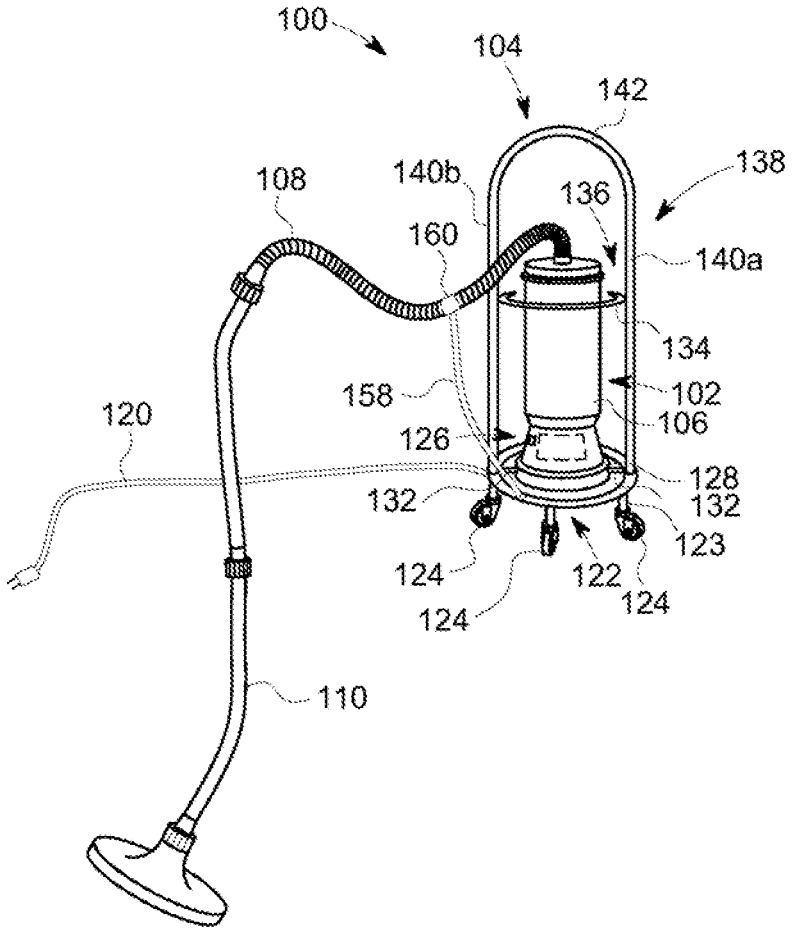
FIG. 8 shows a perspective view of the combined vacuum cleaner and caddy of FIG. 3 in simulated use.

In accordance with common operation of wheel-rolled vacuum cleaners, the user commonly pulls on the entire unit 100 via the hose 108, such as illustrated in FIG. 8. In the present invention, as the user pulls on the hose 108, as simulated in FIG. 8, the pulling force is distributed between the hose 108 upwardly towards the end of the hose 108 mounted to the top of the canister 106, and downwardly via the lead 158 to the lower support assembly 122 of the caddy 104. This redistributed pulling force complements the center of gravity of the combined vacuum cleaner and caddy 100, but more importantly keeps the entire unit 100 from tipping over. Moreover, the pulling force on the hose 108 also pulls up on the lead 158, which helps assist the caddy 104 from easily rolling over obstacles on the floor surface, such as the power cord 120, as shown spread out on the floor in FIG. 8.

The foregoing description of embodiments of the present invention has been presented for the purpose of illustration and description. It is not intended to be exhaustive or to limit the invention to the form disclosed. Obvious modifications and variations are possible in light of the above disclosure. The embodiments described were chosen to best illustrate the principles of the invention and practical applications thereof to enable one of ordinary skill in the art to utilize the invention in various embodiments and with various modifications as suited to the particular use contemplated.

What is claimed is:

1. A mobile caddy for receiving and mounting a portable vacuum cleaner and permitting use of the vacuum cleaner when mounted in the caddy without inhibiting use of the vacuum cleaner separate from the caddy, said caddy comprising:

a lower support assembly comprising a outer support member mounted on a plurality of wheels, and an inner mounting guide adapted to receive and support the lower end of the vacuum cleaner;

a vertical support assembly extending upwardly from the lower support assembly and comprising two vertical support members laterally spaced apart from one another and between which the vacuum cleaner may be positioned when mounted in the caddy; and a lead connected at a first end to the lower support assembly and adapted to be connected at an opposing second end to a hose of the vacuum cleaner when mounted in the caddy and in use of said vacuum collectively with the caddy.

2. The mobile caddy according to claim 1, further comprising an intermediate support mounted on the vertical support assembly a vertical distance up from the lower support assembly, said intermediate support being adapted to surround an upper portion of the vacuum cleaner when mounted in the caddy.

3. The mobile caddy according to claim 2, wherein the intermediate support has a generally circular shape and includes an opening space to facilitate removal of the vacuum cleaner from the caddy for use of the vacuum cleaner separate therefrom.

4. The mobile caddy according to claim 2, further comprising at least one storage unit adapted to be mounted to one of the vertical support assembly and the intermediate support.

5. The mobile caddy according to claim 4, wherein the at least one storage unit is removably connected to the caddy.

6. The mobile caddy according to claim 1, wherein the vertical support assembly further defines a handle for moving the caddy around on a floor surface using the plurality of wheels.

7. The mobile caddy according to claim 6, wherein the handle is defined by a horizontal member of the vertical support assembly extending between the two vertical support members.

8. The mobile caddy according to claim 1, wherein the vacuum cleaner with which the mobile caddy can be used includes a power cord, which power cord can be wrapped around the two vertical support members when the vacuum cleaner is not in use.

9. The mobile caddy according to claim 1, wherein the inner mounting guide is centrally located on the caddy and comprises:

an upper ring having a shape and diameter generally complementing the outer diameter of the lower end of the vacuum cleaner; and a lower ring having smaller diameter than the lower end of the vacuum cleaner and being adapted to support the bottom of said vacuum cleaner.

10. The mobile caddy according to claim 1, wherein the lead is elastic.

11. The mobile caddy according to claim 1, further including means for holding components of the vacuum cleaner when mounted to the caddy but not in use.

12. The mobile caddy according to claim 11, wherein said means includes a projection extending from the lower support assembly for receiving at least one of a hose, hose extension, or nozzle attachment of the vacuum cleaner.

13. A combination vacuum cleaner and caddy comprising:

a vacuum cleaner comprising:

a vacuum canister defining an inner collection receptacle;

a hose extending from a top portion of the vacuum canister and in communication with the inner collection receptacle thereof;

a motor for generating a suction within the canister so as to draw a vacuum force through the hose;

a power cord; and a harness mounted to the outer surface of the vacuum canister permitting the vacuum to be worn by a user; and a caddy for receiving and mounting the vacuum cleaner and permitting use of the vacuum cleaner when mounted in the caddy without inhibiting use of the vacuum cleaner separate from the caddy, said caddy comprising:

a lower support assembly comprising an outer support member mounted on a plurality of wheels, and an inner mounting guide adapted to receive and support the lower end of the vacuum canister;

a vertical support assembly extending upwardly from the lower support assembly and comprising two vertical support members laterally spaced apart from one another and between which the vacuum canister may be positioned when mounted in the caddy; and a lead connected at a first end to the lower support assembly and at an opposing second end to the hose of the vacuum cleaner;

wherein the vacuum canister is centrally axially positioned on the caddy.

14. The combination vacuum cleaner and caddy according to claim 13, further comprising an intermediate support mounted on the vertical support assembly a vertical distance up from the lower support assembly, said intermediate support being adapted to surround an upper portion of the vacuum canister when mounted in the caddy.

15. The combination vacuum cleaner and caddy according to claim 14, wherein the intermediate support has a generally circular shape and includes an opening space to facilitate removal of the vacuum cleaner from the caddy for use of the vacuum cleaner separate therefrom.

16. The combination vacuum cleaner and caddy according to claim 14, further comprising at least one storage unit adapted to be removably mounted to one of the vertical support assembly and the intermediate support.

17. The combination vacuum cleaner and caddy according to claim 13, wherein the power cord can be wrapped around the two vertical support members when the vacuum cleaner is not in use.

18. The combination vacuum cleaner and caddy according to claim 13, wherein the inner mounting guide is centrally located on the caddy and comprises:

an upper ring having a shape and diameter generally complementing the outer diameter of the lower end of the vacuum canister; and a lower ring having smaller diameter than the lower end of the vacuum canister and being adapted to support the bottom of said vacuum canister.

19. The combination vacuum cleaner and caddy according to claim 13, wherein the lead is elastic.

20. The combination vacuum cleaner and caddy according to claim 13, wherein the caddy further includes a projection extending from the lower support assembly for receiving and holding an end of the hose not connected to the canister when the vacuum cleaner is not in use.

* * * * *